US008526853B2

(12) United States Patent
Tada et al.

(10) Patent No.: US 8,526,853 B2
(45) Date of Patent: Sep. 3, 2013

(54) IMAGE FORMING APPARATUS HAVING TONER PASSAGE BLOCKING MECHANISM

(75) Inventors: Kaoru Tada, Osaka (JP); Nobuhiko Kita, Osaka (JP); Sei Onuma, Osaka (JP); Masafumi Takahira, Osaka (JP); Genta Hagiwara, Osaka (JP); Yuusuke Furuichi, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 321 days.

(21) Appl. No.: 12/923,189

(22) Filed: Sep. 8, 2010

(65) Prior Publication Data

US 2011/0064456 A1 Mar. 17, 2011

(30) Foreign Application Priority Data

Sep. 11, 2009 (JP) ..... 2009-210828

(51) Int. Cl.
*G03G 15/08* (2006.01)
*G03G 15/00* (2006.01)

(52) U.S. Cl.
USPC ..... 399/120; 399/108

(58) Field of Classification Search
USPC ..... 399/107, 108, 120, 360
See application file for complete search history.

(56) References Cited

U.S. PATENT DOCUMENTS 4,465,359 A * 8/1984 Nakahata ..... 399/108
4,500,196 A * 2/1985 Shimura ..... 399/35
4,609,281 A * 9/1986 Miyai et al. ..... 399/108
4,635,010 A * 1/1987 Miyai et al. ..... 399/108
4,705,384 A * 11/1987 Mizutani et al. ..... 399/108
4,896,190 A * 1/1990 Uchida et al. ..... 399/108
4,910,551 A * 3/1990 Onoda et al. ..... 399/9
7,555,244 B2 6/2009 Idehara et al.
7,580,653 B2 8/2009 Idehara et al.
7,611,106 B2 11/2009 Kondo et al.
7,676,176 B2 3/2010 Fujiwara et al.
7,677,555 B2 3/2010 Tanaka et al.
7,689,142 B2 3/2010 Kita et al.
2007/0065201 A1 3/2007 Fujiwara et al.
2007/0110473 A1 5/2007 Kondo et al.
2007/0246638 A1 10/2007 Idehara et al.

(Continued)

FOREIGN PATENT DOCUMENTS

JP 6-19606 B2 4/1987
JP 3029750 B2 8/1994
JP 2004082455 A 3/2004
JP 2008225362 A 9/2008

OTHER PUBLICATIONS

English language abstract for JP-06-233018 published Aug. 19, 1994 (which corresponds to JP-3029750-B2).

(Continued)

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

An image forming apparatus includes a handle member that is held by an operator when an orientation of the image forming apparatus is changed from a predetermined use orientation to a different orientation; and a blocking unit that is caused to block a path between the inside and an opening of a toner container, without being powered, in association with an operator operation performed to the handle member upon changing the orientation of the image forming apparatus from the use orientation to the different orientation.

10 Claims, 9 Drawing Sheets

(56) References Cited

U.S. PATENT DOCUMENTS

| | | | |
|---|---|---|---|
| 2008/0006166 | A1 | 1/2008 | Ohkubo et al. |
| 2008/0007935 | A1 | 1/2008 | Kondo et al. |
| 2008/0063425 | A1 | 3/2008 | Idehara et al. |
| 2008/0075502 | A1 | 3/2008 | Tada et al. |
| 2008/0226358 | A1 | 9/2008 | Hanashima et al. |
| 2008/0253796 | A1 | 10/2008 | Idehara et al. |
| 2008/0279585 | A1 | 11/2008 | Furuichi et al. |
| 2008/0292356 | A1 | 11/2008 | Furuichi et al. |
| 2009/0074446 | A1 | 3/2009 | Idehara et al. |
| 2009/0074456 | A1 | 3/2009 | Tada et al. |
| 2009/0080937 | A1 | 3/2009 | Kita et al. |
| 2009/0110432 | A1 | 4/2009 | Idehara et al. |
| 2009/0121418 | A1 | 5/2009 | Tanaka et al. |
| 2009/0285588 | A1 | 11/2009 | Furuichi et al. |
| 2009/0302521 | A1 | 12/2009 | Kondo et al. |
| 2009/0315250 | A1 | 12/2009 | Kimura et al. |
| 2010/0061755 | A1 | 3/2010 | Furuichi et al. |
| 2010/0067942 | A1 | 3/2010 | Hagiwara et al. |

OTHER PUBLICATIONS

English language abstract for JP-62-075662 published Apr. 7, 1987 (which corresponds to JP-6-19606-B2).

* cited by examiner

IMAGE FORMING APPARATUS HAVING TONER PASSAGE BLOCKING MECHANISM

CROSS-REFERENCE TO RELATED APPLICATIONS

The present application claims priority to and incorporates by reference the entire contents of Japanese Patent Application No. 2009-210828 filed in Japan on Sep. 11, 2009.

BACKGROUND OF THE INVENTION

1. Field of the Invention

The present invention relates to image forming apparatuses such as a copier, a printer, and a facsimile, and more particularly to an image forming apparatus that performs image formation using toner.

2. Description of the Related Art

In the area of image forming apparatuses, the size and the weight of an apparatus are being reduced, along with downsizing, functional advancements, and weight reduction of parts thereof. Along with the reductions in the size and the weight of the apparatus, it has become easier for a user to carry the apparatus. Therefore, as one way to use the image forming apparatus, many users store the apparatus in a storage place other than a place where the apparatus is used while the apparatus is not in use, and take out the apparatus from the storage place to the place where the apparatus is used when the user uses the apparatus. In addition, an increasing number of users are using the apparatus frequently changing the place where the apparatus is used.

Generally, because an image forming apparatus has an approximate cuboid shape, the occupied floor area and the shape thereof occupied by the image forming apparatus change depending on the orientation of the apparatus being placed. Therefore, when the apparatus is stored in the storage place while the apparatus is not in use, it is desirable for a user to be able to choose an orientation of the apparatus being placed so that the occupied floor area is minimized, or that the shape of the occupied area matches surroundings in the storage place. However, the image forming apparatus is usually expected to be placed in a predetermined orientation, in which the image forming apparatus is placed when used, or a use orientation, and an unexpected trouble might occur if the apparatus is placed in an orientation other than the use orientation.

In addition, an orientation of the apparatus allowing the user to easily hold it during carrying it is not necessary the same as the predetermined use orientation. If the user holds the apparatus placed in the orientation allowing the user to hold it easily (in the orientation other than the use orientation), an unexpected trouble might occur.

In particular, because it is important for an image forming apparatus designed to be used on a desktop (desktop machine) to have better usability for a sitting user, the desktop machine tends to have a smaller dimension in height than the width or the depth thereof when the machine is placed in the use orientation. If an image forming apparatus having such dimensions is placed in a vertical orientation, where the top surface of the apparatus in the use orientation is placed in parallel with the vertical plane, the occupied floor area can be greatly reduced and storability can be improved in comparison with when the apparatus is placed in a horizontal orientation, which is the use orientation. In addition, when a single user carries the apparatus, the user can hold the apparatus more easily by placing the apparatus in the vertical orientation, and portability is improved. Therefore, it is required especially for an image forming apparatus having such dimensions to be placed in an orientation other than the use orientation. Consequently, it is strongly desirable to solve a problem that might be caused by placing the apparatus in an orientation other than the use orientation.

Japanese Patent Application Laid-open No. H6-19606 discloses an image forming apparatus that solves a problem that, if an operation button or the like of an apparatus being powered is pressed mistakenly while the image forming apparatus is carried or stored in an orientation other than a predetermined use orientation, the apparatus is caused to operate, and the apparatus might be damaged. More specifically, a handle held by a user upon carrying the image forming apparatus is made bendable by means of a hinge, and when the bending operation of the handle is detected while the apparatus is carried, the operation status of the apparatus is switched to and kept at an operation disabled status.

The image forming apparatus disclosed in Japanese Patent Application Laid-open No. H6-19606 can solve the problem that the apparatus might be damaged by being caused to operate when the operation button or the like of the apparatus being powered is mistakenly operated while the apparatus placed in orientation other than the use orientation. However, problems that might occur due to a change in the orientation of the apparatus from the use orientation to a different one are not limited to the one disclosed in Japanese Patent Application Laid-open No. H6-19606. The inventors of the present invention focused on toner scattering, which is one of the most serious problems that might occur.

An image forming apparatus forming an image using toner is usually designed so as not to cause toner scattering while the apparatus is in the predetermined use orientation, but toner scattering might occur when the orientation of the apparatus is changed to an orientation other than the use orientation. In particular, if the orientation of the apparatus is changed to an orientation other than the use orientation, the toner often spills out from parts conveying or storing therein the toner, which causes toner scattering.

Furthermore, in the image forming apparatus disclosed in Japanese Patent Application Laid-open No. H6-19606, even if the apparatus is placed in an orientation other than the use orientation, any trouble would not occur as long as the apparatus is not powered. However, in most cases, the image forming apparatus is not powered while the apparatus is carried or stored. Therefore, to effectively prevent toner scattering that might occur while the apparatus is placed in an orientation other than the use orientation, it is preferable that toner scattering can be prevented even when the apparatus is not powered.

SUMMARY OF THE INVENTION

It is an object of the present invention to at least partially solve the problems in the conventional technology.

According to an aspect of the present invention there is provided an image forming apparatus including: a toner container having a portion defining an opening through which toner contained therein are released or toner is received inside; and a toner conveying channel that is connected to the opening of the toner container to convey the toner from the inside of the toner container or into the toner container. The image forming apparatus forms an image by transferring a toner image, obtained by attaching the toner to a latent image on a latent image carrying body, onto a recording medium. The image forming apparatus further includes: a handle member that is held by an operator when an orientation of the image forming apparatus is changed from a predetermined use orientation to a different orientation; and a blocking unit that is caused to block a path between the inside and the opening of the toner container, without being powered, in association with an operator operation performed to the handle member upon changing the orientation of the image forming apparatus from the use orientation to the different orientation.

According to another aspect of the present invention there is provided an image forming apparatus including: a toner container having a portion defining an opening through which toner contained therein, is released or toner is received inside; and a toner conveying channel that is connected to the opening of the toner container to convey the toner from the inside of the toner container or into the toner container. The image forming apparatus forms an image by transferring a toner image, obtained by attaching the toner to a latent image on a latent image carrying body, onto a recording medium. The image forming apparatus further includes: a displacement member that is displaced, without being powered, by a change in an orientation of the image forming apparatus; and a blocking unit that is caused to block a path between the inside and the opening of the toner container, without being powered, in association with displacement of the displacement member caused when the orientation of the image forming apparatus is changed from a use orientation to a different orientation.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

An embodiment of the present invention (hereinafter, the embodiment is referred to as a "first embodiment") suitable for a laser printer (hereinafter, simply referred to as a "printer") that is an electrophotographic type image forming apparatus will now be explained.

Note that the present invention is not limited to the image forming apparatus according to the first embodiment, and may be applied to any image forming apparatus as long as such it forms an image using toner.

Figure 1:
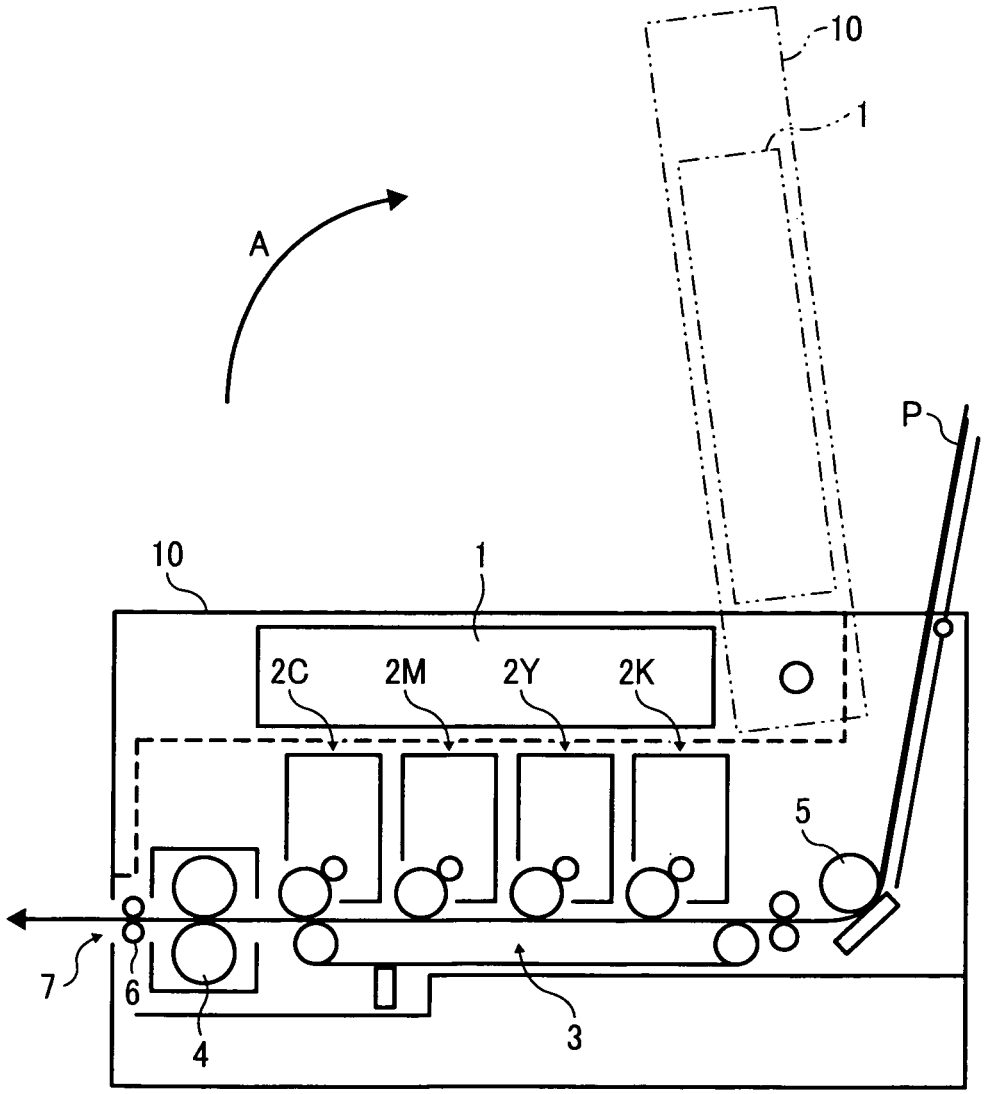
FIG. 1 is a schematic of an overall structure of a printer placed in a use orientation according to a first embodiment of the present invention.

FIG. 1 is a schematic of an overall structure of the printer placed in a use orientation.

The printer mainly includes a writing device 1 as a latent image forming unit, four image forming units 2C, 2M, 2Y, and 2K, a transfer device 3 that is a transfer unit, a fixing device 4 that is a fixing unit, a paper feeding roller 5, and a discharging roller 6. Each of the four image forming units 2C, 2M, 2Y, and 2K has a photosensitive body that is a latent image carrying body, a developing device that is a developing unit, a cleaning device as a cleaning unit, etc. and forms a toner images of four different colors, cyan, magenta, yellow, and black on the photosensitive body.

When a command for forming a color image is received, the writing device 1 writes an electrostatic latent image, in each of the colors corresponding to the image forming command, to the surface of the photosensitive body in each of the image forming units 2C, 2M, 2Y, and 2K. The electrostatic latent image formed on the surface of each of the photosensitive bodies is then developed in the corresponding developing device using toner of each of the colors, to form a toner image on the surface of each of the photosensitive bodies in each of the colors. A single sheet of transfer paper P that is a recording medium placed in a paper feeding tray is fed into the transfer device 3 at a predetermined timing, by means of the paper feeding roller 5. The transfer paper P, carried on a conveying belt in the transfer device 3, passes through transfer sections facing to the surface of each of the photosensitive bodies. While passing through each of the transfer sections, a toner image of each of the colors, formed on the surface of each of the photosensitive bodies, is transferred onto the transfer paper P in a manner overlapping each other. In this manner, a color image is formed on the transfer paper P. The transfer residual toner, remaining on the photosensitive bodies without being transferred onto the transfer paper P, is cleaned by the cleaning device. The transfer paper P on which the color image is formed is sent to the fixing device 4, has the color image fixed thereto, and is ejected out of the apparatus by the discharging roller 6 through an discharging port 7.

In this printer, the writing device 1 is attached to a cover 10 as an opening and closing door. By moving the cover 10 in the direction pointed by the arrow A in FIG. 1 to the position illustrated in a dotted line, the top opening of the printer main body is exposed, and the image forming units 2C, 2M, 2Y, and 2K, each of which is one of replaceable components, can be taken out thorough the top opening.

Figure 2:
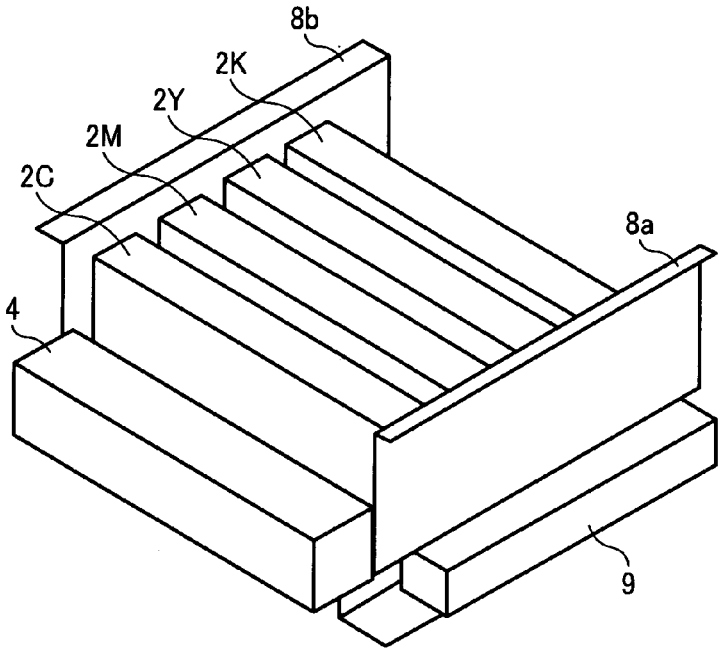
FIG. 2 is a perspective view around image forming units with outer walls of the printer removed.

FIG. 2 is a perspective view around the image forming units 2C, 2M, 2Y, and 2K, with outer walls of the printer removed.

The image forming units 2C, 2M, 2Y, and 2K are placed between right and left side walls 8*a* and 8*b* of the structure of the main body. A waste toner bottle 9 that is a toner container is arranged below the image forming units 2C, 2M, 2Y, and 2K, when the printer is placed in the use orientation. The transfer residual toner collected by the cleaning device in each of the image forming units 2C, 2M, 2Y, and 2K is conveyed to the waste toner bottle 9 via toner conveying channels not illustrated. The toner conveying channels are arranged on the image forming units 2C, 2M, 2Y, and 2K, respectively, and the outlets of the toner conveying channels are separably connected to the opening of a waste toner guide, not illustrated, included in the waste toner bottle 9. The opening of the waste toner bottle 9 that is separably connected to the outlets of the toner conveying channels may be arranged at the mouth of the bottle body, or may be arranged at the tip of a tube extended from the mouth of the bottle body. According to the first embodiment, the image forming units 2C, 2M, 2Y, and 2K can be replaced, leaving the waste toner bottle 9 behind in the printer body.

Figure 3A:
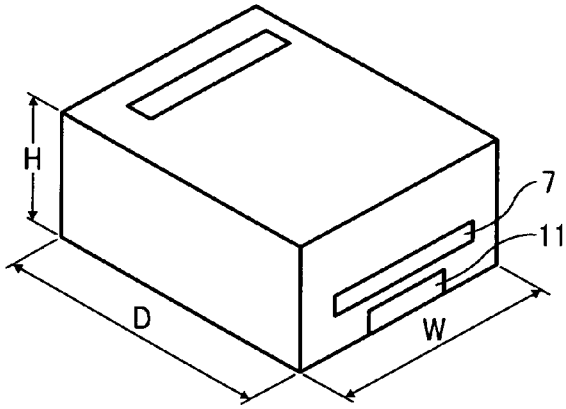
FIG. 3A is a schematic for explaining the printer in the use orientation.
Figure 3B:
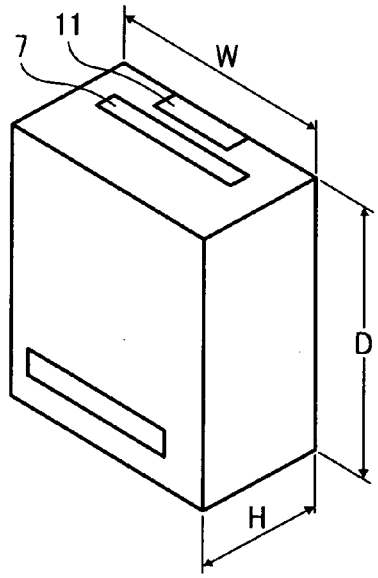
FIG. 3B is a schematic for explaining the printer in a transportation/storage orientation.

FIG. 3A is a schematic of the printer in the use orientation, and FIG. 3B is a schematic of the printer in an orientation, in which the printer is placed when transported and stored, or a transportation/storage orientation.

The symbols W, H, and D in FIGS. 3A and 3B respectively represent the width, the height, and the depth of the printer placed in the use orientation. The relationship between W (the width), H (the height), and D (the depth) in the first embodiment is as illustrated in FIGS. 3A and 3B. Therefore, in the first embodiment, the floor area occupied by the printer placed in the use orientation (W×D) is larger than that occupied by the printer in the transportation/storage orientation (W×H). Therefore, the floor area occupied by the printer can be reduced if the printer is stored in the transportation/storage orientation than that in the use orientation, to achieve storage in a smaller space. In addition, when a user carries the printer with one hand, it is easier for the user to carry the printer in the transportation/storage orientation than in the use orientation.

Figure 4:
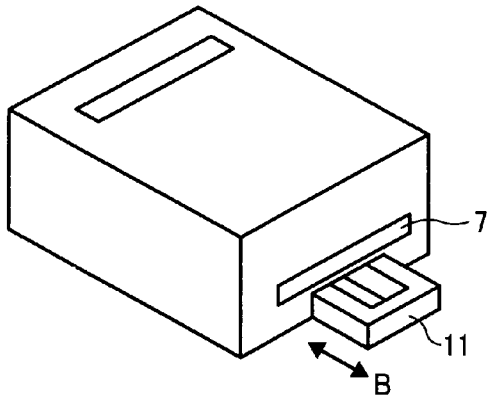
FIG. 4 is a schematic for explaining a handle pulled out of the printer body, placed in the use orientation, into a held position.

FIG. 4 is a schematic for explaining a handle 11 pulled out of the printer body, placed in the use orientation, into a held position.

The handle 11 can be pulled out or pushed in along the direction pointed by the arrow B in FIG. 4 by an operation of a user who is an operator, and is moved between a stored position where the handle 11 is stored inside the printer and a held position where the handle 11 is exposed outside of the printer so that the user can hold it. Upon carrying the printer, the user can easily change the orientation of the printer from the use orientation to the transportation/storage orientation by pulling out the handle 11 to the held position and then holding it. The user can then carry the printer by lifting the printer, holding the handle 11. In this manner, in the first embodiment, the user can perform a series of operations from changing the orientation of the printer to carrying it, all while holding the handle 11. Furthermore, according to the first embodiment, to store the printer, a hook having a sufficient strength may be arranged on a wall extending in a direction approximately perpendicular to the floor, and the handle 11 may be hanged thereon.

Figure 5:
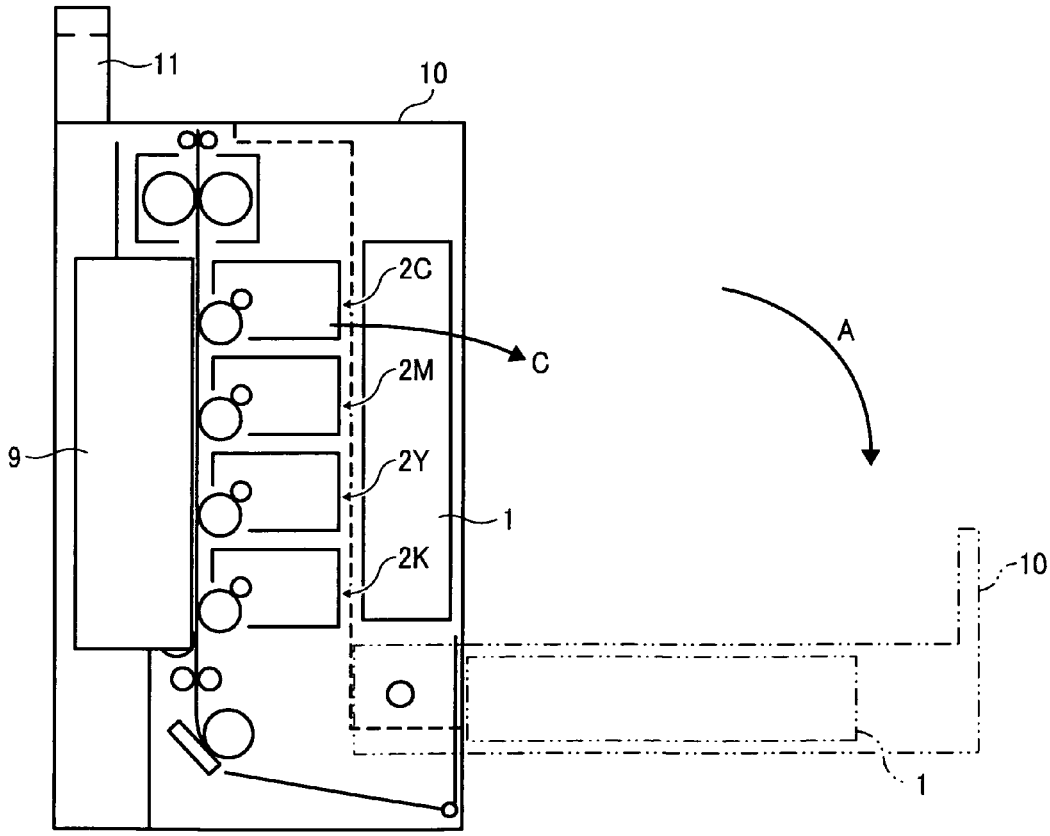
FIG. 5 is a schematic for illustrating an example of the image forming units coming out of the printer placed in the transportation/storage orientation.

FIG. 5 is a schematic for illustrating an example of the image forming units 2C, 2M, 2Y, and 2K coming out of the printer placed in the transportation/storage orientation.

In the first embodiment, to allow the image forming units 2C, 2M, 2Y, and 2K to be replaced while leaving the waste toner bottle 9 behind in the printer body, the outlets of the toner conveying channels arranged on the image forming units 2C, 2M, 2Y, and 2K are connected separably to the opening of the waste toner guide arranged on the waste toner bottle 9. If the printer is placed in the use orientation, the toner would not leak from the separable connection. However, if the printer is changed from the use orientation to the transportation/storage orientation, the waste toner in the waste toner bottle 9 moves toward the opening of the waste toner guide. Therefore, if the separable connection is not well sealed, the toner might leak from the separable connection.

Furthermore, if the user moves the printer, holding the handle 11, from the use orientation to the transportation/storage orientation more forcefully than expected, the momentum caused thereby might cause the cover 10 to open, to cause the image forming units 2C, 2M, 2Y, and 2K to fall out of the printer. If the image forming units 2C, 2M, 2Y, and 2K come out of the printer in the transportation/storage orientation, the outlets of the toner conveying channels on the image forming units 2C, 2M, 2Y, and 2K are separated from the opening of the waste toner guide. Therefore, the waste toner, caused to move to the opening of the waste toner guide when the orientation of the printer is changed, flows out of the opening, resulting in toner scattering.

Therefore, in the first embodiment, a blocking mechanism as a blocking unit that blocks the path between the inside of the waste toner bottle 9 and the opening of the waste toner guide is provided to prevent the toner from leaking from the opening of the waste toner guide that is arranged on the waste toner bottle 9 and separably connected to the outlets of the toner conveying channels on the image forming units 2C, 2M, 2Y, and 2K, even if the orientation of the printer is changed from the use orientation to the transportation/storage orientation.

A structure and an operation of the blocking mechanism will now be explained in detail.

Figure 6A:
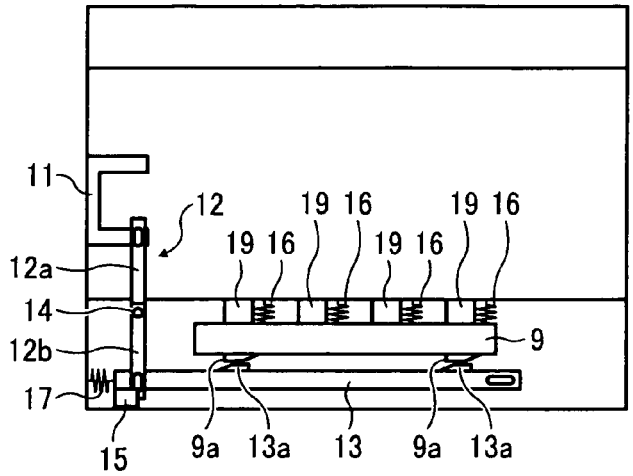
FIG. 6A is a schematic for explaining a blocking mechanism when the printer, operating in the use orientation, is seen from the top.

FIG. 6A is a schematic for explaining the blocking mechanism when the printer, operating in the use orientation, is seen from the top.

Figure 6B:
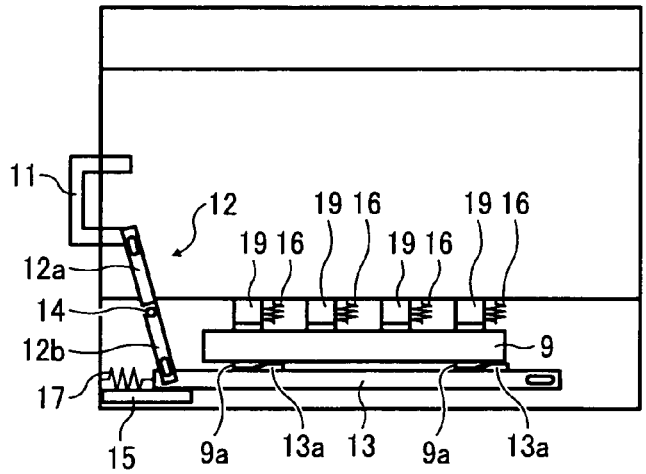
FIG. 6B is a schematic for explaining the blocking mechanism when the handle is pulled out and the orientation of the printer is changed to the transportation/storage orientation.

FIG. 6B is a schematic for explaining the blocking mechanism when the handle 11 is pulled out and the orientation of the printer is changed to the transportation/storage orientation.

Figure 6C:
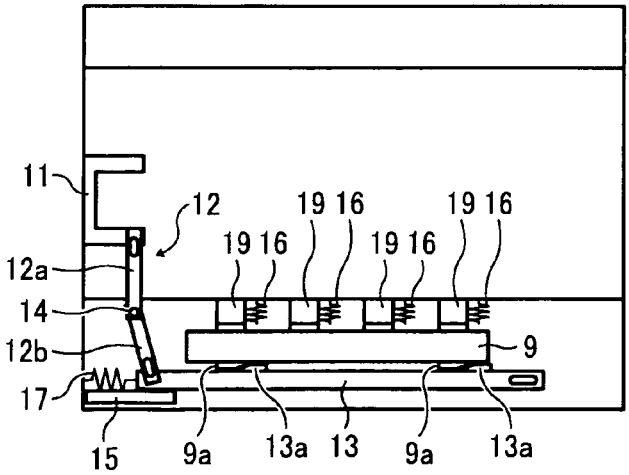
FIG. 6C is a schematic for explaining the blocking mechanism when the handle is pushed into the printer while the printer is kept in the transportation/storage orientation.

FIG. 6C is a schematic for explaining the blocking mechanism when the handle 11 is pushed into the printer while the printer is kept in the transportation/storage orientation.

In the first embodiment, before changing the orientation of the printer from the use orientation illustrated in FIG. 6A to the transportation/storage orientation, the user (operator) pulls out the handle 11 from the printer main body. The blocking mechanism according to the first embodiment is caused to block the connection between the waste toner bottle 9 and the waste toner guide 19 in association with such a pulling operation. More specifically, the blocking mechanism according to the first embodiment mainly includes a linking mechanism 12 that is displaced in association with a pushing or a pulling operation of the handle 11, a retraction link 13 that is displaced in the direction in parallel with the direction of the pulling or pushing operation of the handle 11 in association with the displacement of the linking mechanism 12, pressing springs 16 that bias the waste toner bottle 9 toward the retraction link 13, a retraction spring 17 that biases the retraction link 13 toward the direction the handle 11 is pulled out (leftward in FIGS. 6A to 6C), and a shutter mechanism to be described later.

Protrusions 9*a* and 13*a* are arranged on facing surfaces, facing each other, of the retraction link 13 and the waste toner bottle 9, respectively, at corresponding locations. When the printer is in use orientation illustrated in FIG. 6A, the facing heads of the protrusions 9*a* and 13*a* are in contact with each other, because the retraction link 13 is positioned at a pressing position by the biasing force of the retraction spring 17. In such an arrangement, the waste toner bottle 9 is positioned at a use position against the biasing force of the pressing springs 16. On the contrary, when the retraction link 13 is placed at a non-pressing position, as illustrated in FIG. 6B, against the biasing force of the retraction spring 17, e.g., when the printer is placed in the transportation/storage orientation, the protrusions 9*a* and 13*a* are displaced from the other, and the head of each of the protrusions 9*a* and 13*a* is brought in contact with the facing surface of the other. In this manner, the waste toner bottle 9 is positioned at a retracted position by way of the biasing force of the pressing springs 16. At this time, the shutter mechanism arranged in the connection between the waste toner bottle 9 and the waste toner guide 19 blocks the connection. A structure and an operation of the shutter mechanism will be explained later.

Figure 7:
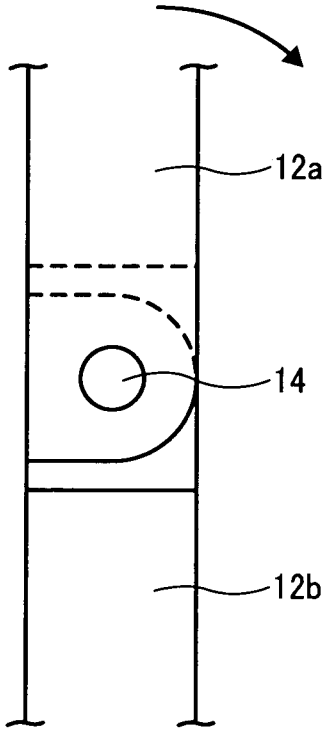
FIG. 7 is an enlarged view around a joint of a linking mechanism in the blocking mechanism.

FIG. 7 is an enlarged view around a joint 14 of the linking mechanism 12.

The linking mechanism 12 has a structure including two links 12*a* and 12*b* joined together at the joint 14. The first link 12*a* is connected to the handle 11, and the second link 12*b* is connected to the retraction link 13. To restrict rotation of the two links 12*a* and 12*b* from the position where these links 12*a* and 12*b* are placed in an approximately linear manner to only one direction, in the linking mechanism 12, an end of each of the links 12*a* and 12*b* is rounded out on the side thereof facing the direction in which rotation is allowed, and is restricted is formed to have an angled corner on the side thereof facing the direction in which the rotation. In this manner, rotation of one of the links 12*a* and 12*b* is restricted by the end surface of the other of the links 12*a* and 12*b*, and thus the rotation is prevented.

An operation of the blocking mechanism will now be explained, using an example where the printer that has been used is carried by a user from a place where it has been used to a different place, and stored therein.

To begin with, the user pulls out the handle 11 from the printer main body, before changing the orientation of the printer from the use orientation illustrated in FIG. 6A to the transportation/storage orientation. In association with the pulling operation of the handle 11, the linking mechanism 12 is rotated about the joint 14 as a fulcrum in the counter clockwise direction in FIG. 6A, while the two links 12*a* and 12*b* are kept in an approximately linear form. By means of the rotation, the retraction link 13 is moved toward the direction in which the handle 11 is pushed in (rightward in FIG. 6B) against the biasing force of the retraction spring 17, and is placed at the non-pressing position. In this manner, the heads of the two protrusions 13*a* arranged on the retraction link 13 are released from, the contact with the heads of the two corresponding protrusions 9*a* arranged on the waste toner bottle 9, and the waste toner bottle 9 is positioned at the retracted position by the biasing force of the pressing springs 16. The connection between the waste toner bottle 9 and the waste toner guide 19 is blocked by the shutter mechanism to prevent the toner from leaking from the opening of the waste toner guide 19.

In the first embodiment, an elongated movement restricting member 15 is arranged rotatably at a pressing position side end of the retraction link 13 (the left end in FIG. 6A). The movement restricting member 15 is rotatable about a rotation axis extending in the direction being horizontal when the printer is placed in the use orientation, and the direction perpendicular to the movement of the retraction link 13, that is, extending in the up-and-down direction in FIG. 6A. When the direction on which the gravity acts changes because the orientation of the printer is changed, the movement restricting member 15 is rotated so that the longitudinal direction thereof is laid in the direction of the gravity. Therefore, when the printer is placed in the use orientation, the movement restricting member 15 is at an unlocking position where the longitudinal direction thereof is laid perpendicular to the direction of the movement of the retraction link 13, as illustrated in FIG. 6A. At this time, the retraction link 13 is allowed to move to the pressing position, without being interfered by the movement restricting member 15. On the contrary, when the printer is placed in the transportation/storage orientation, the movement restricting member 15 comes to a locking position where the longitudinal direction thereof is laid along the direction of the movement of the retraction link 13, as illustrated in FIG. 6B. At this time, even if the retraction link 13 at the non-pressing position is caused to move towards the pressing position by the biasing force of the retraction spring 17, such a movement is restricted because the longitudinal end of the movement restricting member 15 comes in contact with the main body structure. Therefore, when the printer is placed in the transportation/storage orientation, the retraction link 13 is not allowed to move from the non-pressing position to the pressing position, and the retraction link 13 is kept at the non-pressing position. In addition, because the movement restricting member 15 is biased in a direction in which it is brought in contact with the main body structure by the biasing force of the retraction spring 17, the retraction link 13 is kept at the non-pressing position even if the orientation of the printer is changed.

After pulling out the handle 11 from the printer placed in the use orientation illustrated in FIG. 6A, the user holds the handle 11 and changes the orientation of the printer to the transportation/storage orientation illustrated in FIG. 6B. The user then carries the printer to a storage place, holding the handle 11, while keeping the printer in the transportation/storage orientation, and places and stores the printer in the transportation/storage orientation in the storage place. If the handle 11 is kept at the held position while the printer is stored, something might get caught at the handle 11 protruding out from the printer, and might cause the printer to fall down. In addition, if the handle 11 is kept at the held position while the printer is stored, it could be inconvenient because it would be difficult to place anything on top of the printer. Therefore, after placing the printer in the storage place in the transportation/storage orientation, the user presses the handle 11 into the stored position, as illustrated in FIG. 6C. Because the position of the retraction link 13 is kept at the non-pressing position by means of the movement restricting member 15 even if the handle 11 is pressed into the stored position, the connection between the waste toner bottle 9 and the waste toner guide 19 is kept closed by the shutter mechanism, and the toner is still prevented from leaking from the opening of the waste toner guide 19. Furthermore, after the handle 11 is pressed into the stored position in the printer in the transportation/storage orientation, the connection between the waste toner bottle 9 and the waste toner guide 19 is kept closed by the shutter mechanism as long as the handle 11 is kept at the stored position, even if the printer is changed to an orientation other than the transportation/storage orientation (e.g., to the use orientation). Therefore, the toner can be prevented from leaking.

Upon carrying and using the printer stored in the storage place to and in a use place, the user carries the printer in the transportation/storage orientation to the use place, holding the handle 11, and changes the orientation of the printer from the transportation/storage orientation to the use orientation, while still holding the handle 11. At this time, because the handle 11 is receiving a force toward the held position, the retraction link 13 receives a force toward the non-pressing position against the biasing force of the retraction spring 17. In this manner, the biasing force of the retraction spring 17 that keeps the movement restricting member 15 in contact with the main body structure is released. Therefore, when the direction of the gravity acting on the movement restricting member 15 changes because the orientation of the printer is changed to the use orientation, the movement restricting member 15 is rotated, and the longitudinal direction thereof is laid along the direction perpendicular to the movement of the retraction link 13 as illustrated in FIG. 6A. Therefore, if the user releases his/her hand from the handle 11 or presses the handle 11 into the stored position after changing the orientation of the printer to the use orientation, the retraction link 13 is caused to move to the pressing position by the biasing force of the retraction spring 17. As a result, the waste toner bottle 9 is caused to move to the use position, and the shutter mechanism opens the connection between the waste toner bottle 9 and the waste toner guide 19 to allow the waste toner to enter the waste toner bottle 9, and to make the printer usable.

Even if the user presses the handle 11 into the stored position after carrying the printer to the use place but before changing the orientation of the printer from the transportation/storage orientation to the use orientation, the movement restricting member 15 can be brought to the unlocking position from the locking position, simply by pulling the handle 11 to the held position in the printer placed in the use orientation.

The shutter mechanism according to the first embodiment will now be explained.

Figure 8A:
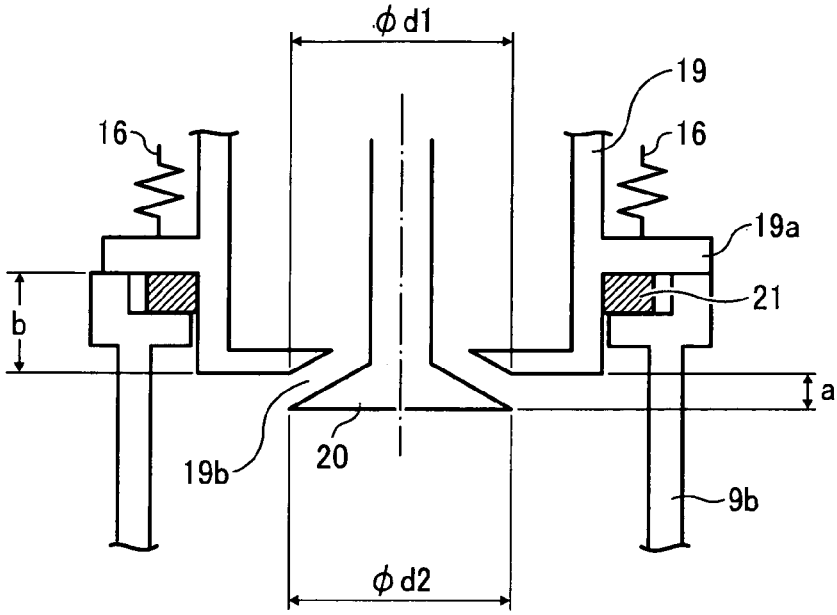
FIG. 8A is a schematic for explaining a shutter mechanism when a waste toner bottle is at a use position.

FIG. 8A is a schematic for explaining a shutter mechanism 20 when the waste toner bottle 9 is at the use position.

Figure 8B:
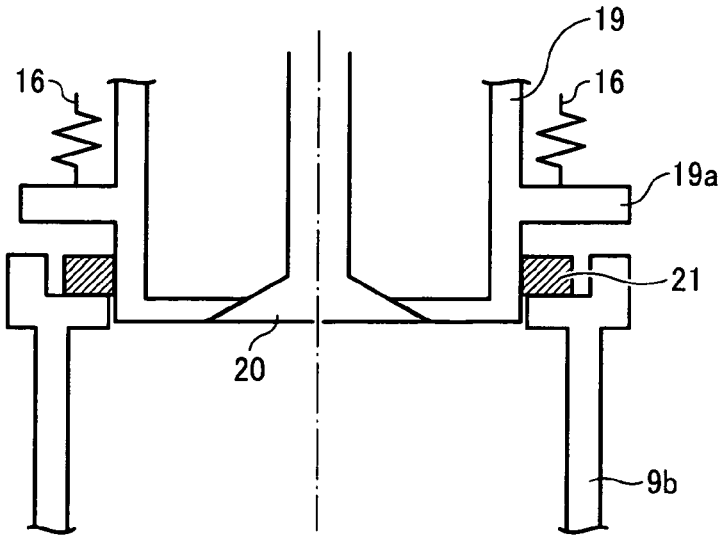
FIG. 8B is a schematic for explaining a shutter mechanism when the waste toner bottle is at a retracted position.

FIG. 8B is a schematic for explaining the shutter mechanism 20 when the waste toner bottle 9 is at the retracted position.

As illustrated in FIGS. 8A and 8B, the shutter mechanism 20 is disposed at the connection between the waste toner bottle 9 and the waste toner guide 19. The shutter mechanism 20 is arranged at a fixed position, and is moved relatively to the waste toner bottle 9 and the waste toner guide 19 as the waste toner bottle 9 and the waste toner guide 19 move. When the printer is placed in the use orientation and the retraction link 13 is placed at the pressing position by the biasing force of the retraction spring 17, the waste toner bottle 9 is placed at the use position, as illustrated in FIG. 6A. At this time, a mouth 9*b* of the waste toner bottle 9 is in contact with a rib 19*a* of the waste toner guide 19, as illustrated in FIG. 8A, pressing the waste toner guide 19 in the upward direction in FIG. 8A against the biasing force of the pressing springs 16. In this manner, the waste toner guide 19 is moved relatively from the shutter mechanism 20 in the upward direction in FIG. 8A, and an outlet 19*b* of the waste toner guide 19 that has been closed by the shutter mechanism 20 is opened. Therefore, the waste toner bottle 9 can accept the waste toner conveyed from the toner conveying channels, arranged on the image forming units 2C, 2M, 2Y, and 2K via the waste toner guide 19.

On the contrary, when the retraction link 13 is placed at the non-pressing position against the biasing force of the retraction spring 17, e.g., when the printer is placed in the transportation/storage orientation, the waste toner bottle 9 is positioned at the retracted position as illustrated in FIG. 6B or FIG. 6C. At this time, the mouth 9*b* of the waste toner bottle 9 is separated from the rib 19*a* on the waste toner guide 19, as illustrated in 8B, and the waste toner guide 19 is moved in the downward direction in FIG. 8B by the biasing force of the pressing springs 16. In this manner, the waste toner guide 19 is moved relatively from the shutter mechanism 20 in the downward direction in FIG. 8B, causing the shutter mechanism 20 to close the outlet 19*b* of the waste toner guide 19. To obtain such a shutter mechanism 20, the symbols $\phi d1$, $\phi d2$, a, and b illustrated in FIG. 8A have to be in a relationship $\phi d1 \leqq \phi d2$ and $a<b$.

In this manner, because the outlet 19*b* of the waste toner guide 19 is closed by the shutter mechanism 20, the waste toner in the waste toner bottle 9 is prevented from flowing into the waste toner guide 19. Therefore, the toner is prevented from leaking from the opening of the waste toner guide 19 that is separably connected to the outlets of the toner conveying channels on the image forming units 2C, 2M, 2Y, and 2K. When the outlet 19*b* of the waste toner guide 19 is closed by the shutter mechanism 20, the downward movement of the waste toner guide 19 in the FIG. 8A is restricted, which leads to the arrangement illustrated in FIG. 8B.

In the first embodiment, the waste toner guide 19 is caused to move relatively to the mouth 9*b* of the waste toner bottle 9, and a sealing member 21 is arranged around the area where the relative movement occurs, as illustrated in FIGS. 8A and 8B, to prevent toner scattering from this area.

If the cover 10 could be opened easily while the printer is placed in the transportation/storage orientation, the cover 10 might be opened by vibrations during transportation, or an impact caused by some object colliding with the printer while being stored. If the cover 10 opens, the image forming units 2C, 2M, 2Y, and 2K might come out the printer, and the waste toner remaining in the toner conveying channels and the waste toner guide 19 might be scattered. Therefore, in the first embodiment, a locking mechanism that is a locking means for locking the cover 10 closed in association with the rotation of the movement restricting member 15 may be provided.

Figure 9A:
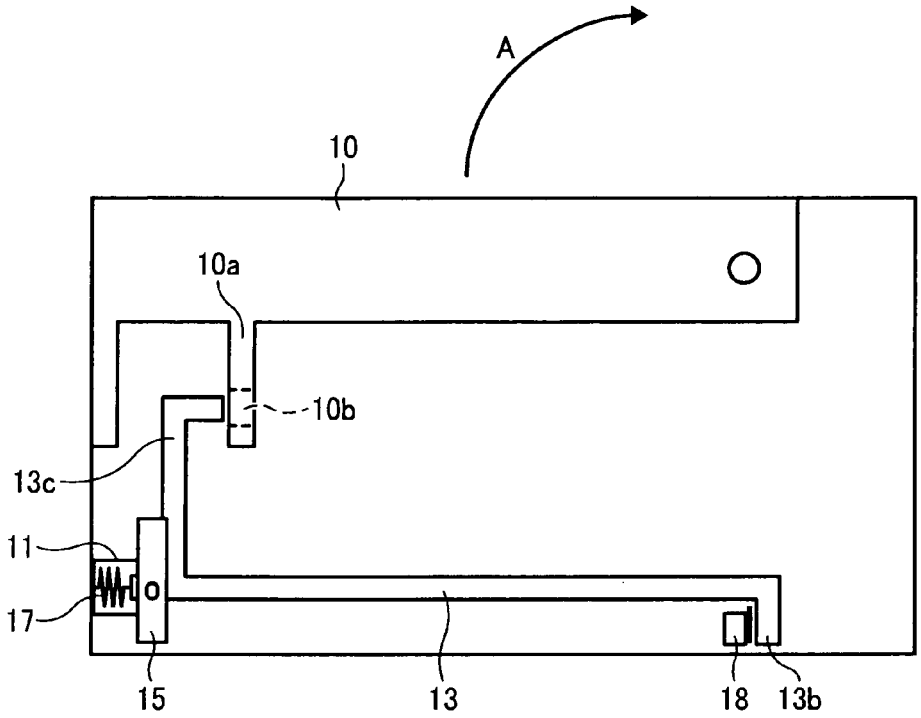
FIG. 9A is a schematic for explaining a locking mechanism when a movement restricting member is at an unlocking position.

FIG. 9A is a schematic for explaining such a locking mechanism when the movement restricting member 15 is at the unlocking position.

Figure 9B:
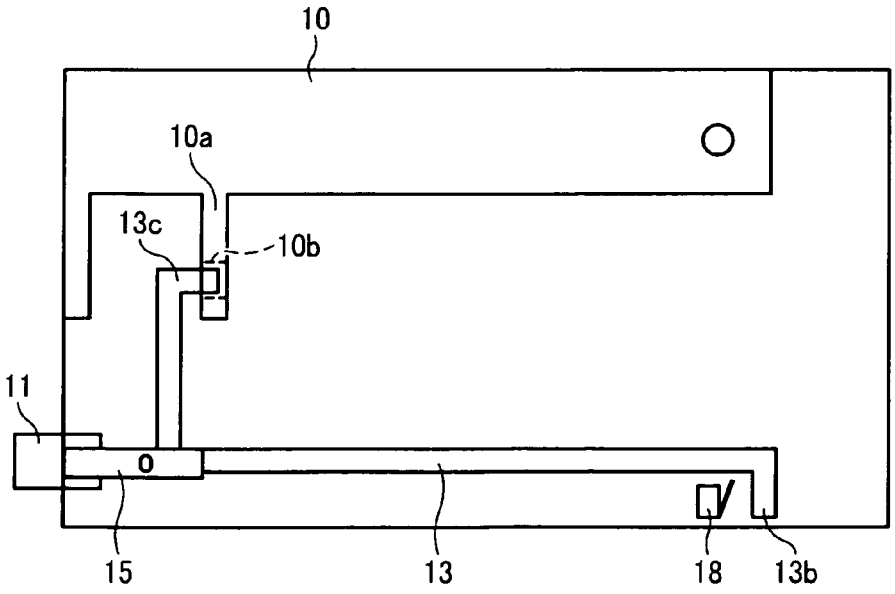
FIG. 9B is a schematic for explaining the locking mechanism when a movement restricting member is at a locking position.

FIG. 9B is a schematic for explaining the locking mechanism when the movement restricting member 15 is at the locking position.

The locking mechanism includes a cover stopper 13*c* fixed to the retraction link 13, and has an insertion hole 10*b* through which the cover stopper 13*c* can be inserted.

When the printer is placed in the use orientation and the retraction link 13 is kept at the pressing position by the biasing force of the retraction spring 17, the cover stopper 13*c* fixed to the retraction link 13 comes to an unlocking position retracted from the insertion hole 10*b* on the cover 10, as illustrated in FIG. 9A. At this time, the cover 10 can be opened and closed. On the contrary, when the retraction link 13 is at the non-pressing position against the biasing force of the retraction spring 17, e.g., when the printer is in the transportation/storage orientation, the cover stopper 13*c* is brought to a locking position where the cover stopper 13*c* is inserted in the insertion hole 10*b* of the cover 10, as illustrated in FIG. 9B. Even if the user attempts to open the cover 10 in this arrangement, the cover stopper 13*c* inserted in the insertion hole 10*b* of the cover 10 prevents the cover 10 from being opened. Therefore, the cover 10 is locked at the closed position.

The cover stopper 13*c* may be formed integrally to the retraction link 13, or as a separate part.

If the printer is powered while the printer is in the transportation/storage orientation that is not the use orientation, an unexpected trouble is likely to occur. Therefore, in the example illustrated in FIGS. 9A and 9B, a micro switch 18 that is an interlocking mechanism is shut off by a rib 13*b* arranged on the retraction link 13, in association with the movement of the retraction link 13. In such a structure, when the printer is placed in the use orientation and the retraction link 13 is kept at the pressing position by the biasing force of the retraction spring 17, the micro switch 18 is turned on, allowing the printer to be powered on. On the contrary, when the retraction link 13 is at the non-pressing position against the biasing force of the retraction spring 17, e.g., when the printer is placed in the transportation/storage orientation, the micro switch 18 is turned off, preventing the printer from being powered on.

As another measure that prevents the printer to be powered on while the printer is in the transportation/storage orientation that is not the use orientation, for example, a power inlet that is an attachment unit to which a power cable is attached may be placed on an outer wall of the printer that serves as the bottom when the printer is in the transportation/storage orientation (the outer wall that is on the opposite side of the outer wall having the handle 11). In this example, because the printer cannot be placed in the transportation/storage orientation unless the power cable is pulled out of the power inlet, the printer can be prevented from being carried or stored, with the power cable connected to the power inlet.

Variation

A variation of the shutter mechanism will now be explained.

Figure 10A:
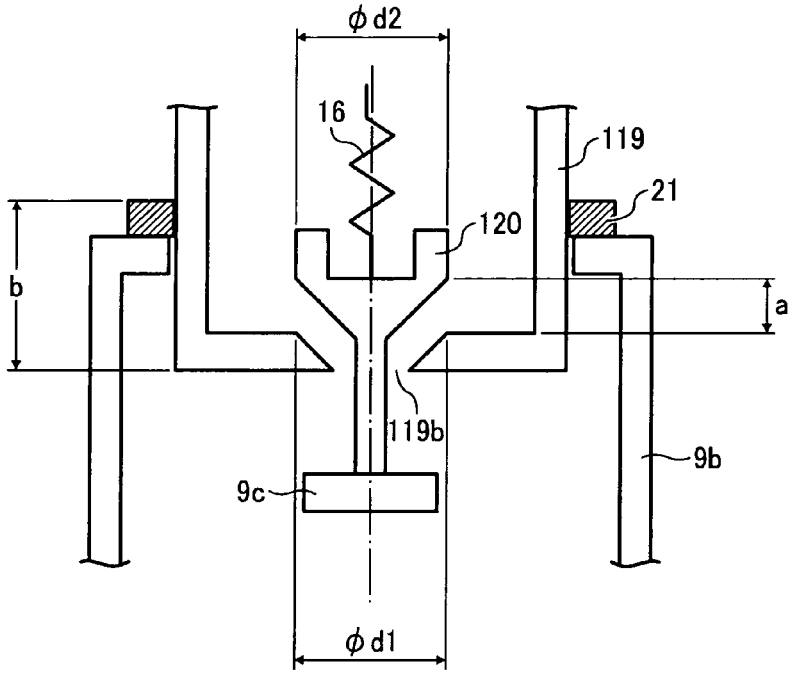
FIG. 10A is a schematic for explaining a shutter mechanism according to a variation when the waste toner bottle is at the use position.

FIG. 10A is a schematic for explaining a shutter mechanism 120 according to the variation when the waste toner bottle 9 is at the use position.

Figure 10B:
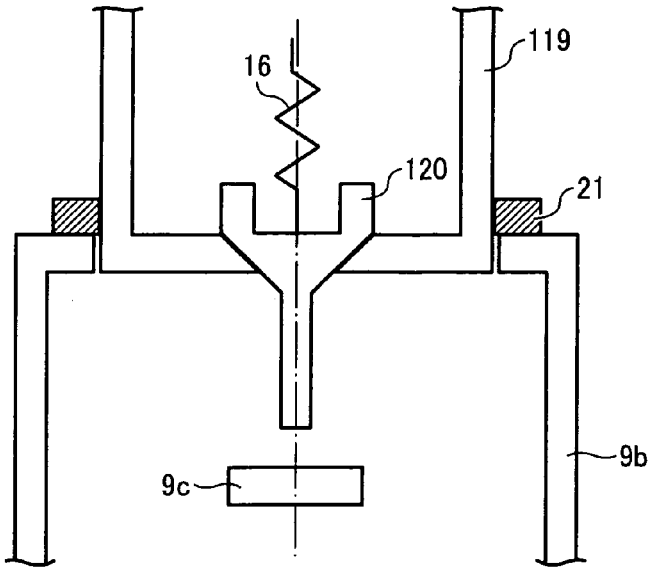
FIG. 10B is a schematic for explaining the shutter mechanism according to the variation when the waste toner bottle is at the retracted position.

FIG. 10B is a schematic for explaining the shutter mechanism 120 according to the variation when the waste toner bottle 9 is at the retracted position.

In this variation, the shutter mechanism 120 is allowed to move in the up-and-down direction in FIGS. 10A and 10B, and a waste toner guide 119 is arranged at a fixed position. The pressing springs 16 are arranged to bias the shutter mechanism 120 in the downward direction in FIGS. 10A and 10B. When the printer is placed in the use orientation and the retraction link 13 is kept at the pressing position by the biasing force of the retraction spring 17, the waste toner bottle 9 comes to the use position as illustrated in FIG. 6A. At this time, an inner rib 9*c* arranged inside of the waste toner bottle 9 is brought in contact with the bottom end of the shutter mechanism 120, as illustrated in FIG. 10A, pressing out the shutter mechanism 120 in the upward direction in FIGS. 10A and 10B against the biasing force of the pressing springs 16. In this manner, an outlet 119*b* of the waste toner guide 119, closed by the shutter mechanism 120, is opened. Therefore, the waste toner bottle 9 can accept the waste toner conveyed from the toner conveying channels, arranged on the image forming units 2C, 2M, 2Y, and 2K via the waste toner guide 119.

On the contrary, when the retraction link 13 is kept at a non-pressing position against the biasing force of the retraction spring 17, e.g., when the printer is placed in the transportation/storage orientation, the waste toner bottle 9 is positioned at the retracted position as illustrated in FIG. 6B or FIG. 6C. At this time, the inner rib 9*c* of the waste toner bottle 9 is separated from the bottom end of the shutter mechanism 120 as illustrated in FIG. 10B, and the shutter mechanism 120 is moved in the downward direction in FIGS. 10A and 10B by the biasing force of the pressing springs 16. In this manner, the outlet 119*b* of the waste toner guide 119 is closed by the shutter mechanism 120. To obtain such a shutter mechanism 120, the symbols $\phi d1$, $\phi d2$, a, and b illustrated in FIG. 10A have to be in a relationship $\phi d1 \leqq \phi d2$ and $a<b$.

In this manner, the outlet 119*b* of the waste toner guide 119 is closed by the shutter mechanism 120 to prevent the waste toner in the waste toner bottle 9 from flowing into the waste toner guide 119. Therefore, the toner is prevented from leaking from the opening of the waste toner guide 119 that is separably connected to the outlets of the toner conveying channels on the image forming units 2C, 2M, 2Y, and 2K.

Second Embodiment

Another embodiment of the present invention (hereinafter, this embodiment is referred to as a "second embodiment") applied to a printer, in the same manner as in the first embodiment, will now be explained.

In the second embodiment, when the orientation of the printer is changed from the use orientation to the transportation/storage orientation, the shutter mechanism 20 or 120 is caused to close the connection between the waste toner bottle 9 and the waste toner guide 19. The basic structure and the operation of the printer according to the second embodiment are the same as those according to the first embodiment. Therefore, explanations will be given below only on portions that are different from the first embodiment.

Figure 11A:
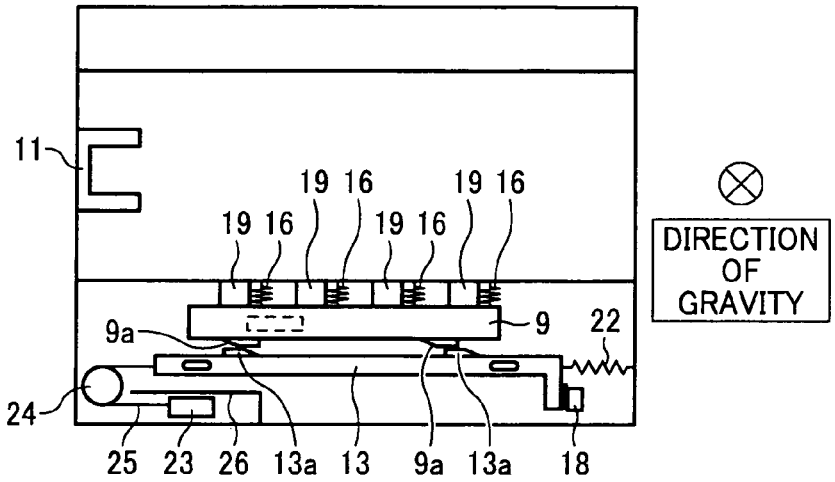
FIG. 11A is a schematic for explaining the blocking mechanism when the printer, operating in the use orientation, is seen from the top.

FIG. 11A is a schematic for explaining the blocking mechanism when the printer, operating in the use orientation, is seen from the top.

Figure 11B:
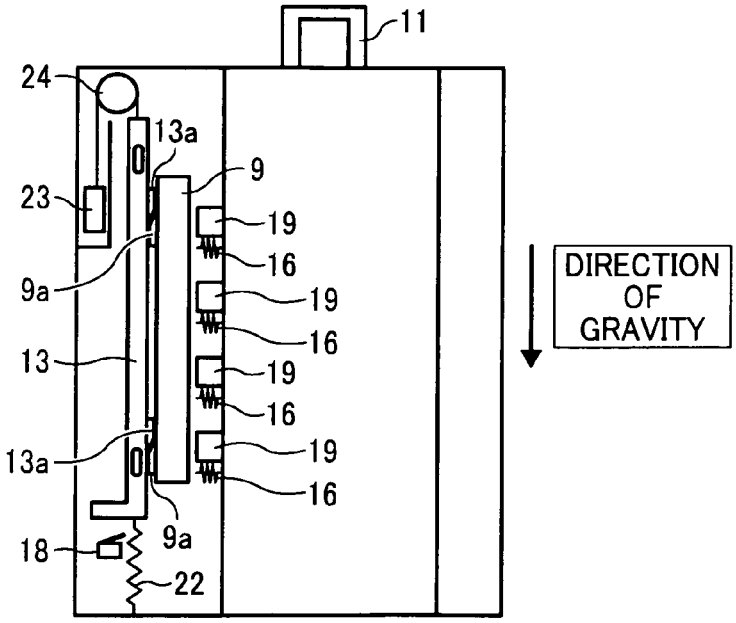
FIG. 11B is a schematic for explaining the blocking mechanism when the printer is placed in the transportation/storage orientation.

FIG. 11B is a schematic for explaining the blocking mechanism when the printer is placed in the transportation/storage orientation.

In the second embodiment, the retraction link 13 is associated with a movement of a weight 23, instead of the pulling and the pushing operations of the handle 11. More specifically, at one end of the retraction link 13 near the handle, that is, the upper end of the retraction link 13 when the printer is placed in the transportation/storage orientation, the weight 23 is connected using a string-like connecting member 25 via a pulley 24. The weight 23 is allowed to move in the direction of the movement of the retraction link 13, but the movement in any other directions is restricted by a weight guide 26. Furthermore, a retraction spring 22 is attached to the other end of the retraction link 13 to bias the retraction link 13 in the direction toward the pressing position thereof, that is, in the downward direction when the printer is in the transportation/storage orientation.

When the printer is placed in the use orientation as illustrated in FIG. 11A, the retraction link 13 is kept at the pressing position by the biasing force of the retraction spring 22, and the waste toner bottle 9 is positioned at the use position against the biasing force of the pressing springs 16. At this time, the connection between the waste toner bottle 9 and the waste toner guide 19 is released from a closure by the shutter mechanism 20 or 120, and is opened. On the contrary, when the retraction link 13 is placed at the non-pressing position as illustrated in FIG. 11B against the biasing force of the retraction spring 22, e.g., when the printer is placed in the transportation/storage orientation, the waste toner bottle 9 is kept at the retracted position by the biasing force of the pressing springs 16. At this time, the connection between the waste toner bottle 9 and the waste toner guide 19 is closed by the shutter mechanism 20 or 120.

An operation of the blocking mechanism will now be explained, using an example where the printer that has been used is carried by a user from where it has been used to a different place, and stored therein, as in the first embodiment.

To begin with, the user changes the orientation of the printer from the use orientation illustrated in FIG. 11A to the transportation/storage orientation illustrated in FIG. 11B, holding the handle 11. In this time, the gravity acts on the weight 23 to cause the weight 23 to fall in the direction of the gravity, that is, the downward direction in FIG. 11B. By means of this movement of the weight 23, the retraction link 13 is lifted in the upward direction according to the gravity direction, that is, the upward direction in FIG. 11B, against the biasing force of the retraction spring 22, and is positioned at the non-pressing position. In this manner, the heads of the two protrusions 13*a* arranged on the retraction link 13 are released from the contact with the heads of the two corresponding protrusions 9*a* arranged on the waste toner bottle 9, and the waste toner bottle is brought to the retracted position by the biasing force of the pressing springs 16. The connection between the waste toner bottle 9 and the waste toner guide 19 is closed by the shutter mechanism 20 or 120, preventing the toner from leaking from the opening of the waste toner guide 19.

In the second embodiment, the micro switch 18 is shut off by the retraction link 13 moving to the non-pressing position. Therefore, when the printer is placed in the transportation/storage orientation, the printer is prevented from being powered on.

On the contrary, when the printer stored in the storage place is carried to and used in the use place, the user carries the printer in the transportation/storage orientation to the use place, holding the handle 11, and changes the orientation of the printer from the transportation/storage orientation to the use orientation, while still holding the handle 11. In this manner, the direction of the gravity acting on the weight 23 changes to a direction perpendicular to the direction in which the weight 23 is allowed to move, that is, in the direction perpendicular to the direction of the movement of the retraction link 13. As a result, the retraction link 13 is moved to the pressing position by the biasing force of the retraction spring 22. Thereby, the waste toner bottle 9 is moved to the use position, and the shutter mechanism 20 or 120 opens the connection between the waste toner bottle 9 and the waste toner guide 19, allowing the waste toner to be accepted into the waste toner bottle 9, and allowing the printer to be used.

In addition, because the micro switch 18 is turned on by the displacement of the retraction link 13 to the pressing position, the printer can be powered on.

To achieve the operation according to the second embodiment, a relationship between the weight 23, the retraction spring 22, and the pressing springs 16 has to satisfy in equation (1) below representing a condition for allowing the retraction link 13 to be displaced to the non-pressing position, and in equation (2) below representing a condition for allowing the retraction link 13 to be displaced to the pressing position:

$$M\times g>F0+k1\times x1+\mu w\times n\times k2\times x2 \quad (1)$$

$$\mu m\times M\times g+\mu w\times n\times k2\times x2<F0 \quad (2)$$

where the parameters used in formulas (1) and (2) are as follows:

M: The mass of the weight 23 [kilogram]

k1: The spring constant of the retraction spring 22 [N/mm]

k2: The spring constant of the pressing springs 16 [N/mm]

x1: The distance of the displacement of the weight 23 [mm]

x2: The distance of the displacement of the waste toner bottle 9 [mm]

F0: The initial tension of the retraction spring 22 [N]

n: The number of the pressing springs 16

μw: The friction coefficient between the retraction link 13 and the waste toner bottle 9

μm: The friction coefficient between the weight 23 and the weight guide 26 g: The gravity acceleration [$m/s^2$]

As describe above, the printers according to the first and the second embodiment each include the waste toner bottle 9 that is a toner container having the opening for accepting the waste toner, and the toner conveying channels that are connected to the opening of the waste toner bottle 9 so as to convey the toner into the waste toner bottle 9, and form an image by transferring a toner image, obtained by attaching a toner to a latent image on the photosensitive bodies, onto the transfer paper P as a recording medium.

In the first embodiment, the printer includes the handle 11 that is a handle member that is held by the user who is an operator when the orientation of the printer is changed from the predetermined use orientation to the transportation/storage orientation that is different form the use orientation, and a blocking mechanism as a blocking unit that blocks the path between the inside and the opening of the waste toner bottle 9, operating, without being powered on, in association with a user operation performed to the handle 11 (an operation of pulling out of the handle 11 from the printer main body) before changing the printer from the use orientation to the transportation/storage orientation. Such a structure prevents the toner from leaking from the opening while the printer is placed in the transportation/storage orientation. Furthermore, because the blocking operation of the blocking mechanism is associated with the operation without being powered, even if the printer is not powered on, the path between the inside of the waste toner bottle 9 and the opening of the waste toner guide can be blocked before the orientation of the printer is changed to the transportation/storage orientation. Therefore, toner scattering can be prevented.

In particular, in the first embodiment, by means of a user operation, the handle 11 can be moved between the stored position where the handle 11 is stored inside the printer and the held position where the handle 11 is exposed outside of the printer so that the user can hold it. The operation mentioned above is the pulling operation performed by the user, moving the handle 11 from the stored position to the held position. In this manner, the user can simply perform a normal operation of pulling out and holding the handle 11, without performing any special operation, to block the opening before the orientation of the printer is changed to the transportation/storage orientation, to prevent toner scattering.

Furthermore, in the first embodiment, the blocking mechanism keeps the opening closed even when the handle 11 is moved to the stored position, and opens the opening when the handle 11 is positioned at the held position while the printer is placed in the use orientation. Such a structure can prevent toner scattering even if the handle 11 is moved to the stored position when the printer is placed in the transportation/storage orientation.

In the second embodiment, the printer includes the weight 23 that is a displacement member that is displaced without being powered when the orientation of the printer is changed from the use orientation to the transportation/storage orientation, and the blocking mechanism as a blocking means that blocks the path between the inside and the opening of the waste toner bottle 9 in association with the displacement of the weight 23, without being powered. Such a structure prevents the toner from leaking from the opening when the printer is placed in the transportation/storage orientation. Furthermore, because the displacement of the weight 23 and the blocking operation of the blocking mechanism are performed without being powered, even if the printer is not powered, toner scattering can be prevented in the printer placed in the transportation/storage orientation.

In the explanations of the first and the second embodiments, the waste toner in the waste toner bottle 9 is prevented from being scattered from the opening of the waste toner bottle 9. However, the present invention may also be applied, in the same manner, to prevent a supplementary toner from being scattered from an opening of a toner bottle having such an opening for releasing the supplementary toner stored therein.

Furthermore, the printers according to the first and the second embodiments each include the cover 10 as an opening-and-closing door that opens and closes the opening of the main body to allow replaceable parts (e.g., the image forming units 2C, 2M, 2Y; and 2K) in the printer main body to be inserted to or removed from the printer may body, and the locking mechanism of 13*c* and 10*b* that is a locking unit that locks the cover 10 closed, without being powered, in associating with the pulling operation of the handle 11 or the displacement of the weight 23. Such a structure prevents the cover 10 from being opened by vibrations during transportation or an impact caused by some object colliding with the printer while being stored, so that the image forming units 2C, 2M, 2Y, and 2K would not come out of the printer, and the waste toner remaining in the toner conveying channels and the waste toner guide 19 would not be scattered.

Furthermore, if the power inlet that is an attachment unit to which a power cable is attached may be placed on the outer wall of the printer that serves as the bottom when the printer is in the transportation/storage orientation, because the printer cannot be placed in the transportation/storage orientation unless the power cable is pulled out of the power inlet, the printer can be prevented from being carried or stored with the power cable connected to the power inlet. According to a first aspect of the present invention, when the operator changes the orientation of the image forming apparatus to an orientation other than the use orientation upon carrying or storing the image forming apparatus, the operator performs the operation to the handle, and then changes the orientation of the apparatus while holding the handle. According to this aspect of the present invention, the opening of the toner container is closed in association with the operation performed by the operator to the handle. Therefore, before the orientation of the image forming apparatus is changed from the use orientation to a different one, the path between the inside and the opening of the toner container is blocked by the blocking unit. Therefore, even if the orientation of the image forming apparatus is changed from the use orientation to a different one, the toner in the toner container can be prevented from leaking from the opening, thus toner scattering can be prevented. Furthermore, according to this aspect of the present invention, the blocking operation of the blocking unit is associated with the operation of the operator without being powered. Therefore, even when the image forming apparatus is not powered, the path between the inside and the opening of the toner container can be blocked before changing the orientation of the image forming apparatus and toner scattering can be prevented.

According to another aspect of the present invention, when the operator changes the orientation of the image forming apparatus to an orientation other than the use orientation upon carrying or storing the image forming apparatus, the displacement member is displaced, and the opening of the toner container is closed in association with the displacement. Therefore, when the orientation of the image forming apparatus is changed from the use orientation to a different orientation, the path between the inside and the opening of the toner container is blocked by the blocking unit. Therefore, even if the orientation of the image forming apparatus is changed from the use orientation to a different orientation, the toner in the toner container can be prevented from leaking from the opening, and toner scattering can be prevented. Furthermore, according to this aspect of the present invention, because the displacement of the displacement member and the blocking operation of the blocking unit are performed while the power is not supplied, the path between the inside and the opening of the toner container can be blocked and toner scattering can be prevented upon changing the orientation of the image forming apparatus, even when the image forming apparatus is not powered. Advantageously, according to the present invention, toner scattering that could occur when the apparatus is placed in an orientation other than the use orientation can be effectively prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a toner container having a portion defining an opening through which toner contained therein are released or toner is received inside; and a toner conveying channel that is connected to the opening of the toner container to convey the toner from the inside of the toner container or into the toner container, wherein the image forming apparatus forms an image by transferring a toner image, obtained by attaching the toner to a latent image on a latent image carrying body, onto a recording medium, and the image forming apparatus further comprises:

a handle member that is held by an operator when an orientation of the image forming apparatus is changed from a predetermined use orientation to a different orientation; and a blocking unit that is caused to block a path between the inside and the opening of the toner container, without being powered, in association with an operator operation performed to the handle member upon changing the orientation of the image forming apparatus from the use orientation to the different orientation.

2. The image forming apparatus according to claim 1, wherein the handle member is allowed to move between a stored position where the handle member is stored by the operator in the image forming apparatus and a held position where the handle member is exposed outside of the image forming apparatus to allow the operator to hold the handle member, and the operator operation is an operator operation of moving the handle member from the stored position to the held position.

3. The image forming apparatus according to claim 2, wherein the blocking unit keeps the opening closed even when the handle member is moved to the stored position, and opens the opening when the handle member is positioned at the held position while the image forming apparatus is placed in the use orientation.

4. The image forming apparatus according to claim 1, wherein the toner container is a waste toner bottle that stores therein used toner conveyed along the toner conveying channel.

5. The image forming apparatus according to claim 1, further comprising:

an opening-and-closing door that opens and closes an opening on an apparatus main body for allowing a replacement part to be inserted in or removed from the apparatus main body; and a locking unit that locks the opening-and-closing door closed, without being powered, in association with the operator operation performed to the handle member.

6. An image forming apparatus comprising:

a toner container having a portion defining an opening through which toner contained therein is released or toner is received inside; and a toner conveying channel that is connected to the opening of the toner container to convey the toner from the inside of the toner container or into the toner container, wherein the image forming apparatus forms an image by transferring a toner image, obtained by attaching the toner to a latent image on a latent image carrying body, onto a recording medium, and the image forming apparatus further comprises:

a displacement member that is displaced, without being powered, by a change in an orientation of the image forming apparatus; and a blocking unit that is caused to block a path between the inside and the opening of the toner container, without being powered, in association with displacement of the displacement member caused when the orientation of the image forming apparatus is changed from a use orientation to a different orientation.

7. The image forming apparatus according to claim 6, wherein the displacement member is a weight that is caused to displaced by an act of gravity when the image forming apparatus is placed either in the use orientation or in the different orientation.

8. The image forming apparatus according to claim 6, wherein the toner container is a waste toner bottle that stores therein used toner conveyed along the toner conveying channel.

9. The image forming apparatus according to claim 6, further comprising:

an opening-and-closing door that opens and closes an opening on an apparatus main body for allowing a replacement part to be inserted in or removed from the apparatus main body; and a locking unit that locks the opening-and-closing door closed, without being powered, in association with the operator operation performed to the handle member or in association with the displacement of the displacement member.

10. An image forming apparatus comprising:

a toner container having a portion defining an opening through which toner contained therein are released or toner is received inside; and a toner conveying channel that is connected to the opening of the toner container to convey the toner from the inside of the toner container or into the toner container, wherein the image forming apparatus forms an image by transferring a toner image, obtained by attaching the toner to a latent image on a latent image carrying body, onto a recording medium, and the image forming apparatus further comprises:

a handle member that is held by an operator when an orientation of the image forming apparatus is changed from a predetermined use orientation to a different orientation; and a blocking unit that is caused to block a path between the inside and the opening of the toner container, without being powered, in association with movement of the handle member upon changing the orientation of the image forming apparatus from the use orientation to the different orientation.

* * * * *